United States Patent [19]

Ledewitz

[11] Patent Number: 5,024,354

[45] Date of Patent: Jun. 18, 1991

[54] COLLAPSIBLE DISPENSING CONTAINER

[76] Inventor: William Ledewitz, 31 Brookwood Dr., Woodbridge, Conn. 06525

[21] Appl. No.: 91,322

[22] Filed: Sep. 1, 1987

Related U.S. Application Data

[60] Continuation-in-part of Ser. No. 891,057, Jul. 28, 1986, abandoned, which is a continuation of Ser. No. 607,731, May 9, 1984, abandoned, which is a division of Ser. No. 568,281, Jan. 4, 1984, Pat. No. 4,493,439, which is a continuation-in-part of Ser. No. 284,826, Jul. 20, 1981, abandoned, which is a continuation-in-part of Ser. No. 208,663, Nov. 20, 1980, abandoned.

[51] Int. Cl.[5] ..... B65D 35/22; B67D 5/60

[52] U.S. Cl. ..... 222/94; 222/107; 222/143

[58] Field of Search ..... 222/92, 94, 105, 107, 222/566, 569, 143

[56] References Cited

U.S. PATENT DOCUMENTS

| | | | |
|---|---|---|---|
| 1,188,115 | 6/1916 | Thompson | 222/107 |
| 2,258,395 | 10/1941 | Tome | 222/107 |
| 2,332,414 | 10/1943 | Tome | 222/92 |
| 2,386,498 | 10/1945 | Ostrander | 222/107 |
| 3,260,411 | 7/1966 | Dobson | 222/107 |
| 3,661,301 | 5/1972 | Couland | 222/92 |
| 3,724,722 | 4/1973 | Ballo | 222/105 |

FOREIGN PATENT DOCUMENTS

| | | | |
|---|---|---|---|
| 295349 | 2/1968 | Australia | 222/107 |
| 869291 | 1/1942 | France | 222/92 |
| 529433 | 6/1955 | Italy | 222/107 |
| 347400 | 4/1931 | United Kingdom | 222/107 |
| 561620 | 5/1944 | United Kingdom | 222/92 |
| 1327803 | 8/1973 | United Kingdom | 222/92 |

*Primary Examiner*—Kevin P. Shaver
*Attorney, Agent, or Firm*—Alfred E. Miller

[57] ABSTRACT

A collapsible dispensing container provided with a conical-shaped head portion having a central opening and a multilaminate tubular body. One end of the tubular body is folded over and defines an annular space between the folded over part and the upstanding wall part of the tubular body. A disc-like barrier member is provided with a peripheral flange that is located in the annular space and heat sealed to adjacent parts of the tubular body. The tubular bodies are formed with a slight taper for nesting, resulting in ease of handling and shipping.

2 Claims, 3 Drawing Sheets

Fig. 1.
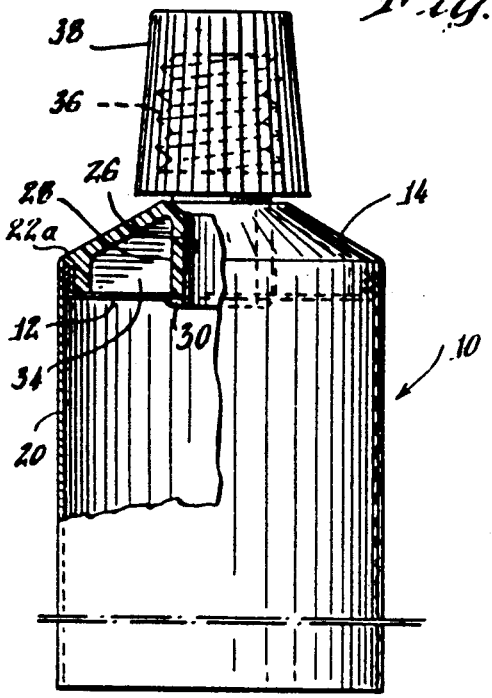
Fig. 4.
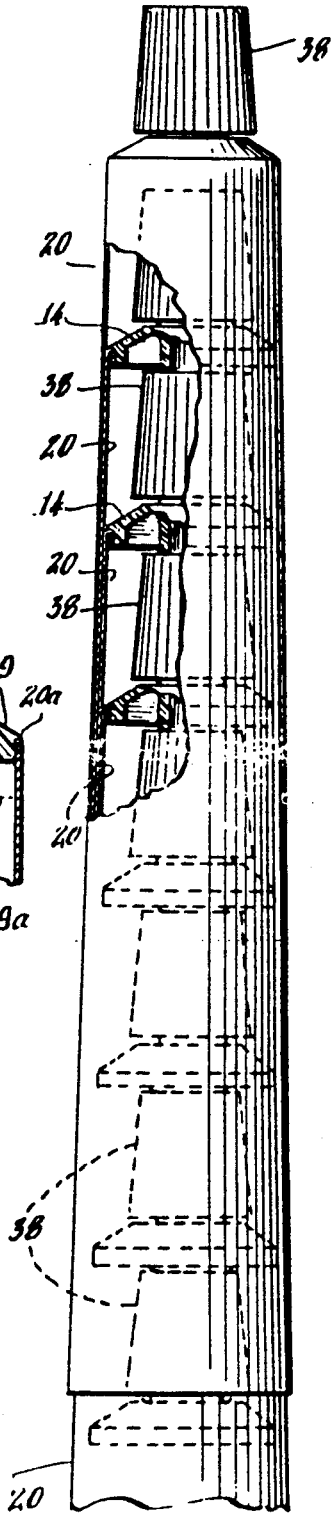
Fig. 5.
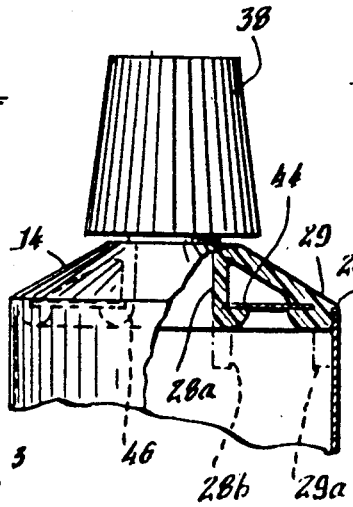
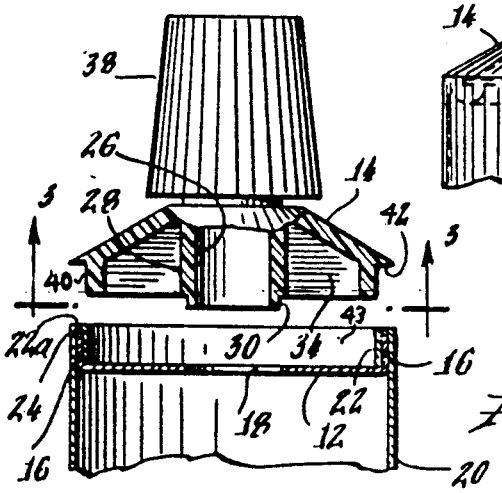
Fig. 2.
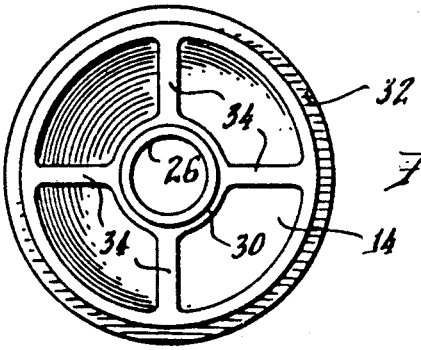
Fig. 3.

COLLAPSIBLE DISPENSING CONTAINER

This application is a continuation-in-part of U.S. application Ser. No. 891,057, filed July 28, 1986, now abandoned, which is a continuation of U.S. application Ser. No. 607,731, filed May 9, 1984, now abandoned, which is a division of U.S. application Ser. No. 568,281, filed Jan. 4, 1984, now U.S. Pat. No. 4,493,439, issued Jan. 15, 1985, which is a continuation-in-part of U.S. application Ser. No. 284,826, filed July 20, 1981, now abandoned, which is a continuation-in-part of U.S. application Ser. No. 208,663, filed Nov. 20, 1980, now abandoned.

The present invention relates to a collapsible container in which toothpaste, shaving cream, and other types of viscous substances are dispensed from. The container is typically in the form of an elongated tube which can be squeezed in order to eject the contents therefrom.

It is important to insure that the contents of the tube are not penetrated by atmospheric air from the exterior thereof, and to additionally insure that the tube contents do not migrate through the walls of the tube to the atmosphere. The tubular body of the dispensing container is constituted of a multi-ply laminate having an aluminum foil layer that is generally coated with inner and outer plies of plastic, such as polyethylene, thereby forming an excellent oxygen and moisture barrier to prevent flavor loss and product deterioration. Examples of such a construction are shown in U.S. Pat. No. 3,295,725 to Brandt and U.S. Pat. No. 3,307,738 to Scheindel.

In the past, the loss of flavor and product deterioration in the head portion of the collapsible tube was prevented by the means of a barrier in the form of a urea or polyester funnel-shaped insert that was inserted in the interior of the head portion of the collapsible tube, such as shown in U.S. Pat. No. 4,011,968 to McGhee et al. Thus, the funnel-shaped insert and the funnel-shaped head of the collapsible tube were complementary. However, this arrangement was found to be too costly and complicated to manufacture, and due to a moisture absorption caused expansion and resultant stress cracking of the outer material thereof.

It is an object of the present invention to provide a barrier member fabricated of a laminate of plastic and aluminum foil having a circular flange on its outer periphery which is inserted in the space created by 180° turnover of the upper end of the longitudinal tube. The flange and the upper end of the longitudinal tube are then heat sealed together to form a diaphragm in which no moisture absorption will occur, thus preventing permeation into the shoulder area of the tube.

It is a further object of the present invention to fuse all exposed laminate edges of the tube with polyethylene to thereby prevent adverse chemical reaction.

It is a further object of the present invention to provide a neck portion on said tube head which is upset or peened over the inner exposed edges of said diaphragm, thereby providing protection against adverse chemical reaction.

It is a further object of the present invention to construct collapsible tubes which have a taper of approximately 1° so that tubes can be nested for handling and shipping. In addition, the present unique packaging permits the use of considerably less storage space in warehousing the present products. Furthermore, this arrangement allows for automation of assembly lines for packing for shipment, as well as for filling the dispensing containers at the customers' plate. The nesting of the tubular dispensers in rod-like packages prevents the entrance of foreign substances within the tubes to create contamination therein. Moreover, these rod-like packages, when assembled, are rigid, and therefore reduce deformation during handling in transport of the dispensing containers.

The present arrangement for shipping collapsible dispensing containers of multi-ply laminate tubes, which are of the type commonly used in toothpaste containers, is to stand up 154 open ended containers in a tray and to stack the trays on a pallet six or eight high. The entire assembly is shrunk-wrapped with a thin plastic material. Quite often the shrink wrap material is penetrated or punctured during shipping, leaving openings whereby dirt and contamination can find its way into the interior of the package, which, of course, overcomes the sanitary initially precaution taken in packing and shipping the containers for eventual filling from the open ends by automatic machinery.

Applicant's invention is directed to a method for packing and shipping a multiplicity of collapsible dispensing containers which are open ended in long sticks or tubes. Because the opposite walls are flared over their entire length at an overall distance of 0.011 inches when stacked, a dimension that has been empirically found by experimentation, the stacked tubes do not score each other, or in any way mar successive tubes. Most importantly, the tubes remain in a sanitary condition because they are held within each other so that the interiors can not be penetrated. Furthermore, the arrangement of flaring the tubes gradually makes the overall tube design not unlike the familiar toothpaste tube in appearance that is generally accepted by the purchasing public, and at the same time permits the tube to be de-nested automatically so that ease of de-nesting and the maintaining of hygienic conditions are achieved.

Yet another object of the present invention is the provision of reinforcing ribs in the head portion of the collapsible tube to prevent the collapsing of the head portion when the tube is squeezed at various locations. In addition, the ribs act as a support for the barrier member, which is a laminated disc.

It is another object of the present invention to provide a collapsible tube constituting a dispensing container which is provided with a head and neck portion in which the neck has a relatively thick wall to deter permeation, the lower free end of which is upset or peened over against the underside of a diaphragm laminate barrier in the form of a punched out web of material comprising a round disc with a center hole. The head portion is provided with sloping sides, the lower free ends of which are also upset or peened over against the underside of said diaphragm barrier. The foregoing construction results in an inexpensive barrier member that can be easily inserted within the head and neck portion of the collapsible tube, and in which the exposed ends of the barrier are covered by the upset portions of the neck and head of the collapsible tube, respectively.

It is another object of the present invention to provide a diaphragm barrier member in the form of a flat disk, while the reinforcing ribs are located between the barrier member and the interior of the head portion, but below the neck of said tube.

It is a further object of the present invention to provide a tubular or cylindrical collapsible squeeze tube which is fabricated from prelaminated sheet material and thermally sealed and flowed along the interior and exterior seams thereof, thus forming an unbroken seal of polyethylene along the exposed edges.

In order that the invention will be more clearly understood, it will now be disclosed in greater detail with reference to the accompanying drawings, in which:

FIG. 1 is a front elevation view, partly in section, of the collapsible container constructed in accordance with the teachings of the present invention.

FIG. 2 is a partial side elevation view of the structure shown in FIG. 1, before the head portion thereof is secured to said cylindrical body.

FIG. 3 is a cross-sectional view taken along the lines 3—3 of FIG. 2.

FIG. 4 shows a plurality of collapsible containers, each having a 1° taper on the sides of said collapsible tubes so that the same may be stacked for ease of handling and shipping, etc.

FIG. 5 is another embodiment of the present invention using an annular, disk-like diaphragm barrier whereby the shoulder and neck portion of the elongated tube are upset or peened over the rear surface of said disk-like barrier member, and heat sealed to said member.

Figure 6:
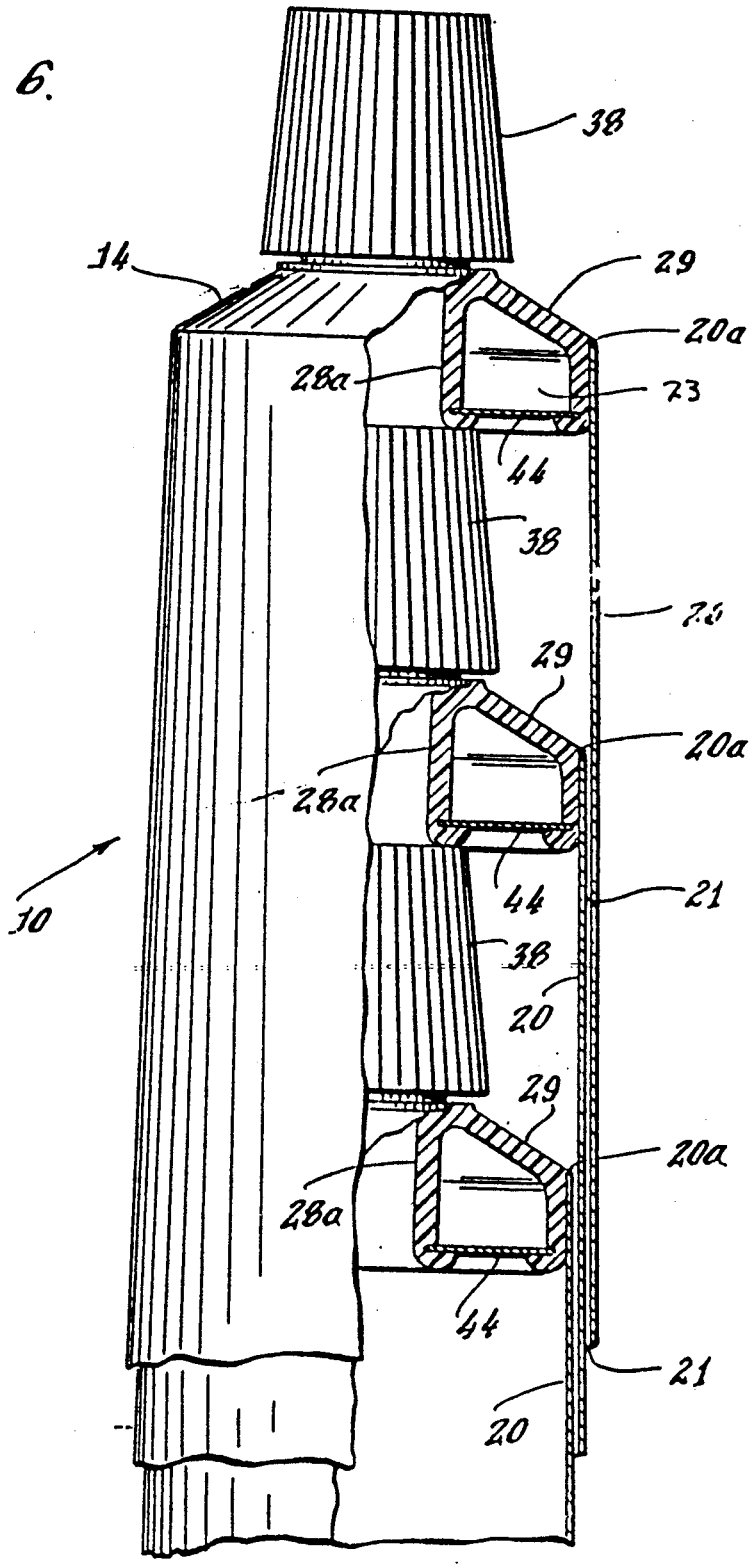
FIG. 6 is an enlarged cross-sectional view of the plurality of collapsible containers shown in FIG. 4.

Referring to FIGS. 1–3, a collapsible tube, such as a toothpaste or similar dispensing container is referred to generally by the numeral 10 which is produced from a prelaminated sheet material that is thermally scaled along the interior and exterior seams thereof. The multiple ply laminate is of the known type in which the metal foil is coated with inner and outer plies of plastic, such as polyethylene (not shown). This laminate forms an excellent oxygen and moisture barrier to prevent loss of flavor and product deterioration. However, the loss of flavor and oxygen penetration in the head portion of the tube is a problem that is somewhat relieved by the insertion of a urea or polyester, funnel-shaped insert having a polyethylene covering, which is known as a barrier member. The use of such an insert is both costly and sometimes ineffective due to moisture absorption which causes expansion and consequently results in the cracking of the outer material thereof. In order to overcome the above objections, a barrier member 12 is shown in FIG. 2 before it is assembled to the dispensing head portion 14 of the collapsible tube. The barrier member 12 is provided with an annular peripheral flange 16 and a hole 18. The tubular body 20 has its upper end 22 folded over approximately 180° to form a space 24 therebetween. Subsequently, the side wall of the tubular member 20 is heat sealed with the turnover portion 22, as well as the annular flange 16 of the barrier member 12. This arrangement prevents permeation of moisture in the shoulder area and head portion of the collapsible tube.

The head portion 14 is provided with a central opening 26, as well as a neck portion 28, the latter of which passes through aperture 18, and is upset or peened over the exposed edges in the opening 18 of the barrier member, thus sealing the same against chemical action from the product within the container. The peening or upsetting of the end 30 of the neck 28 can be accomplished by the use of heat and pressure, such as a hot rotary tool, or sonic welding, induction heating, or any other suitable method for fusing the end 30 about the exposed edges of the opening 18 in the barrier member 12.

The collapsible tube head portion is further provided with an annular reinforcing member 32 having ribs 34, as shown in FIG. 3, and which is inserted between the barrier member 12 and the inner surface of top portion 14. This structure functions to strengthen the top portion 14 of the collapsible tube 10 which, of course, is not squeezable like the elongated tubular member 20, as well as preventing the tube shoulder from warping. In addition, the ribs 34 act as a support for the barrier member laminate 12. The neck portion 28 has a threaded extension 36 directed away from the tubular body 20, and which is adapted to receive a screw threaded cap 38. As seen in FIG. 2, the head portion 14 is provided with an annular downturned flange 40, and a triangular-shaped lateral projection 42 so that when the neck portion 14 is assembled to the tubular body portion 20 by heat sealing the flange 40 fits tightly within the recess 43, with the outer edges thereof tightly engaging the adjacent surface of the folded over flange 22. Moreover, the triangular projection 42 rests on top of the connecting part **22*a* of the folded over flange. Thereafter, the tubular body portion 20 and the folded over end 22 thereof together with the annular flange 16 of the barrier member and the downturned flange 40, as well as the lateral projection 42, are all thermally sealed together to form a tight connection, as seen in FIG. 1, which prevents oxygen and water vapor transmission from entering the tube 10**.

Referring to FIG. 4, a series of open bottom collapsible tubes 10 are shown in a nested condition. The nesting of the tubes 10 is made possible since elongated tubular bodies 20 are each tapered about 1° to their vertical axes. It should be evident that this configuration results in space saving relative to shipping and handling. Furthermore, the bottom ends of the stacked and tapered tubes are not exposed to dust and other contamination, with the exception of the lowermost tube which can be covered in a sanitary fashion. In order to prevent jamming when nesting dispensing containers, caps are secured to the screw threaded neck portions of each tubular body, and the containers with caps are nested. In this manner, the individual containers can be easily and rapidly pulled apart or disassembled. FIG. 6 shows an enlarged view of the nested collapsible tubes 10.

It should be evident that the head and neck construction of the container can be incorporated with the tapered tubular bodies as seen in FIG. 4.

FIG. 5 shows another embodiment of the present invention in which a laminated disc 44 formed of a punched-out web of material that is generally circular in shape, and has a central opening 46. The disc is in inserted in the neck portion 14. The laminated tube body 20 is provided with a top **20*a* extending also vertically, and which is adapted to be heat sealed to the head portion 14. The latter is provided with a neck rib portion 28*a*, as well as a shoulder rib portion 29, both of which have respective rib extensions 28*b* and 20*a*, as shown in dotted lines in FIG. 5. The extensions 28*a* and 29*a* are peened over or upset onto the undersurface of diaphragm 44, as shown in full lines therein. The neck portion 28*a* of the embodiment shown in FIG. 5 has a certain thickness in order to overcome the possible permeation therethrough due to the lack of a barrier member in the neck area. It should be noted that the neck rib 28***a* extends vertically and substantially parallel to the longitudinal axis of the tube body 20, while the shoulder rib 29 extends at an obtuse angle relative to the rib 28*a* thereby forming a space 23 therebetween and located above the disc 44.

It should also be evident that the distance between the top of the cap to the peened over extensions 28*a* and 29*a* is critical since each nesting succeeding collapsible tube with their caps 38 in place are so spaced vertically when nested to form a gap 21 between adjacent tube bodies of approximately 0.0055 inches. The provision of this gap has the desirable result that there will be no scoring of the outside surface of each relatively soft plastic laminate tube by following tube when nested. Furthermore, modern filling technology of collapsible tubes, for example for toothpaste, has brought the filling speed up to 400 units per minute. Obviously, rapid denesting is a necessity, and therefore the provision of a gap of approximately 0.011 inches permits a fast separating of the nested tubes in order to satisfy modern filling line needs.

Applicant has established, after considerable experimentation, that the optimum distance between adjacent walls of concentric nested tubes is about 0.0055 inches, which permits efficient and trouble-free high speed automatic denesting of the stacked tubes for the filling operation.

Therefore, applicant's novel method of handling and delivering conical-shaped tubes compiled or stacked in sticks or rods makes for ease of packaging and staring as well as providing automation for both packing and filling of the tubes.

Figure 7:
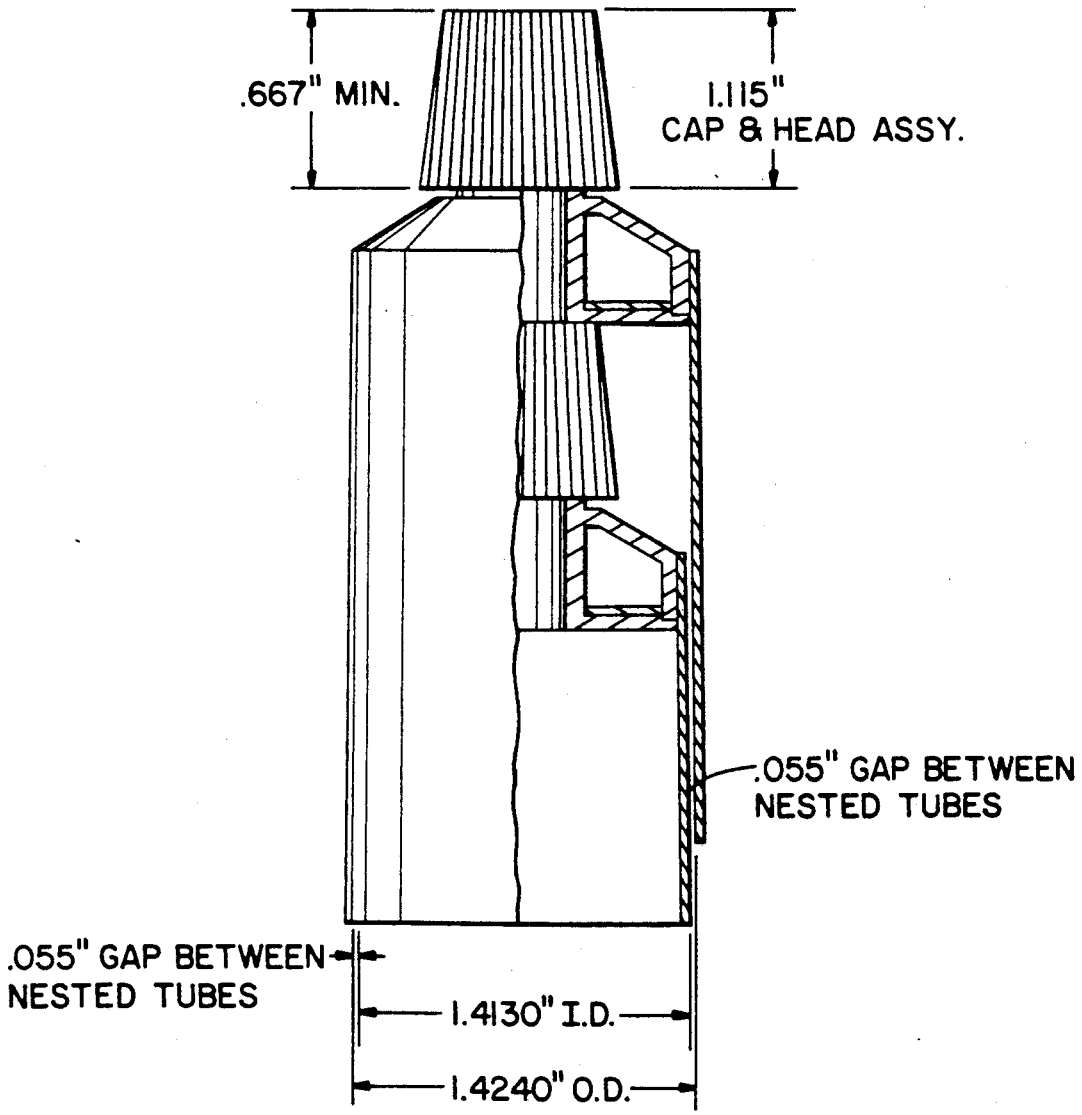
FIG. 7 is a reduced cross sectional view of a plurality of collapsible containers illustrated in FIG. 6 showing the dimensions which create the 0.0055 inch gap between nested containers.

As seen in FIG. 7 two vertically stacked containers are shown having an 0.0055 inch gap between the sides of the nested tubes. As illustrated, the inside diameter of the gap is 1.4130 inches while the outside diameter of the gap is 1.4240 inches and the vertical distance from the top of the tube cap to the bottom abutment stop of the neck of the bottle is 1.115 inches. It is submitted that these dimensions are critical in order to ensure that a uniform spacing between the spaced sides of stacked containers are reliably 0.0055 inches.

What is claimed is:

1. A method of packing a plurality of open ended collapsible dispensing tube-like containers in a nested assembly, each having a common longitudinal axis, and each being provided with a cap, for handling and shipping comprising: fabricating each tubular body of the collapsible tube with about a one degree external taper over the entire length of said tubular body and providing ahead portion having a neck with an extension which extends toward the bottom end of the tube and the end surface of said extension being proximate to the open end of said tube functioning as an abutment stop, the combined distance between the top surface of said cap and the bottom surface of said extension of each tube-like container being so selected to form a gap of 0.0055 inches between adjacent tube walls over the entire length thereof when the tubes have the same longitudinal axis, and nesting a series of said containers by inserting each successive container in the open end of a prior container with its cap abutting the abutment stop of said neck extension resulting in an elongated package of containers whereby each entire tubular body wall is spaced from the entire adjacent tubular body wall by 0.0055 inches to prevent lacking of the nested tubes and to facilitate high speed and automatic de-nesting, since less side pressure is required to be applied to each tubular body in order to separate the tubular body from the remainder of the nested assembly.

2. A method of packing a plurality of open ended collapsible dispensing tube-like containers in a nested assembly, each having a common longitudinal axis, and each being provided with a cap, for handling and shipping comprising: fabricating each tubular body of the collapsible tube with about a one degree external taper over the entire length of said tubular body and providing a head portion having a neck with an extension which extends toward the bottom end of the tube and the end surface of said extension being proximate to the open end of said tube functioning as an abutment stop, the combined distance between the top surface of said cap and the bottom surface of said extension of each tube-like container being 1.115 inches, and the inside tube having a maximum O.D. of 1.4130 inches while the adjacent outside tube has an I.D. of 1.4240 inches whereby a gap of 0.0055 inches between adjacent tube walls over the entire length thereof is established when the tubes have the same longitudinal axis, and nesting a series of said containers by inserting each successive container in the open end of a prior container with its cap abutting the abutment stop of said neck extension resulting in an elongated package of containers whereby each entire tubular body wall is spaced from the entire adjacent tubular body wall by 0.0055 inches to prevent lacking of the nested tubes and to facilitate high speed and automatic de-nesting, since less side pressure is required to be applied to each tubular body in order to separate the tubular body from the remainder of the nested assembly.

* * * * *

UNITED STATES PATENT AND TRADEMARK OFFICE

CERTIFICATE OF CORRECTION

PATENT NO. : 5,024,354

DATED : June 18, 1991

INVENTOR(S) : William Ledewitz

It is certified that error appears in the above-identified patent and that said Letters Patent is hereby corrected as shown below:

Column 5, line 33, change "staring" to --storing--.

Column 6, line 2, change "ahead" to --a head--.
line 17, change "lacking" to --locking--.
line 47, change "lacking" to --locking--.

Signed and Sealed this

Twenty-ninth Day of September, 1992

*Attest:*

DOUGLAS B. COMER

*Attesting Officer*

*Acting Commissioner of Patents and Trademarks*